United States Patent [19]

Henry

[11] 4,389,740

[45] Jun. 28, 1983

[54] BATH TUB HEAD REST

[76] Inventor: Hugh A. Henry, P.O. Box 1892, St. Thomas, V.I. 00801

[21] Appl. No.: 261,601

[22] Filed: May 7, 1981

[51] Int. Cl.[3] ..... A47K 3/022

[52] U.S. Cl. ..... 4/575; 248/118; 297/408

[58] Field of Search ..... 4/519, 523, 575, 515, 4/621; 248/118, 415, 416; 297/391, 408

[56] References Cited

U.S. PATENT DOCUMENTS

| | | | |
|---|---|---|---|
| 437,188 | 9/1890 | Franklin | 248/415 |
| 522,192 | 7/1894 | Browne | 4/523 X |
| 2,200,247 | 5/1940 | Haas | 4/575 |
| 2,992,435 | 4/1961 | Rosa et al. | 4/575 |
| 3,026,537 | 3/1962 | Schnell | 4/621 |
| 3,124,328 | 3/1964 | Kortsch | 248/118 |
| 3,438,606 | 4/1969 | Rubin | 248/415 |
| 3,929,309 | 12/1975 | De Vore | 248/118 |

*Primary Examiner*—Charles E. Phillips
*Attorney, Agent, or Firm*—Richard L. Miller

[57] ABSTRACT

A bath tub head rest is provided with a mounting support that allows it to pivot in an up-and-down direction and to rotate to provide maximum comfort and use. The head rest is supported on the bottom of the bath tub by a suction cup and is mounted to a wall by brackets. The head rest is rotatable by a post telescopingly mounted in a column having the brackets and suction supported by it, while the swivelling up-and-down movement is provided by a tongue connected to the head rest and received in a channel at the top of the post.

5 Claims, 3 Drawing Figures

BATH TUB HEAD REST

BACKGROUND OF THE INVENTION

The present invention is directed to a head rest for use in a bath tub by persons who are ill and suffering from rheumatism and other ailments which prevent them from supporting and turning their heads with ease.

It has hitherto been the case with arthritic and rheumatic sufferers that bathing in a bath tub has caused severe discomfort and pain due to strain and pressures exerted on the neck and other parts of the body. Not only comfort but actual mobile ability is affected by such ailment.

SUMMARY OF THE INVENTION

It is, therefore, the primary object of the present invention to provide a head rest for a bathtub to be used by sufferers of arthritis, rheumatism, and the like, so that their heads and necks are supported to provide a greater degree of comfort and mobility.

To this end, the head rest of the present invention is mounted to a bath tube at the location containing the water outlets, and is made so that the head rest is pivotal in an up-and-down fashion, and also made so that it is rotatable, so that the bather may turn his or her head to view the surroundings while bathing.

The bath tub head rest of the present invention is provided with a heat rest shell member conforming to the typical shape of the back of the head, in which the bather rests his head while bathing. The head rest shell is pivotally mounted in a post, which post in turn is telescopingly mounted in an elongated hollow column. The column is directly mounted to a wall of the bathroom and is supported on the bottom surface of the bath tub by a suction cap at its lower end.

The head rest shell member is pivotally connected to the post by the tongue having a tenon extension, which tenon fits into a channel diametrically formed across the top end of the post, so that the tenon, tongue and head rest shell member swivel in the channel when force is applied thereto. The particular position of the head rest that is most confortable to the bather may then be readily achieved by this pivotting in the up-and-down directions, and when such optimal location is found, the head rest shell is locked in place by a lock wheel having a threaded shank receivable through an opening in the post and an opening in the tenon.

The post, which is telescopingly mounted in the hollow column, is rotatably mounted on this column by a first circumferential flange and a first ring bearing on the post itself at a location between the two ends of the post. The ring bearing on the post rests upon a second ring bearing provided on the hollow column, which second ring bearing is supported on a second circumferential flange provided on the top end of the hollow column, to thereby provide a free rotatable mounting for the post.

The head rest shell is typically made of a compressed plastic material with a layer of sponge material overlaid with a waterproof layer. The post, bearings, flanges, and column are preferably made of chrome-plated steel.

BRIEF DESCRIPTION OF THE DRAWING FIGURES

The invention will be more readily understood with reference to the accompanying drawing, wherein FIG. 1 is a perspective view of the head rest of the present invention mounted in a bath tub;

FIG. 2 is a front elevational view of the head rest of the present invention; and FIG. 3 is a side view of the head rest of the invention.

DETAILED DESCRIPTION OF THE PREFERRED EMBODIMENT

Figure 1:
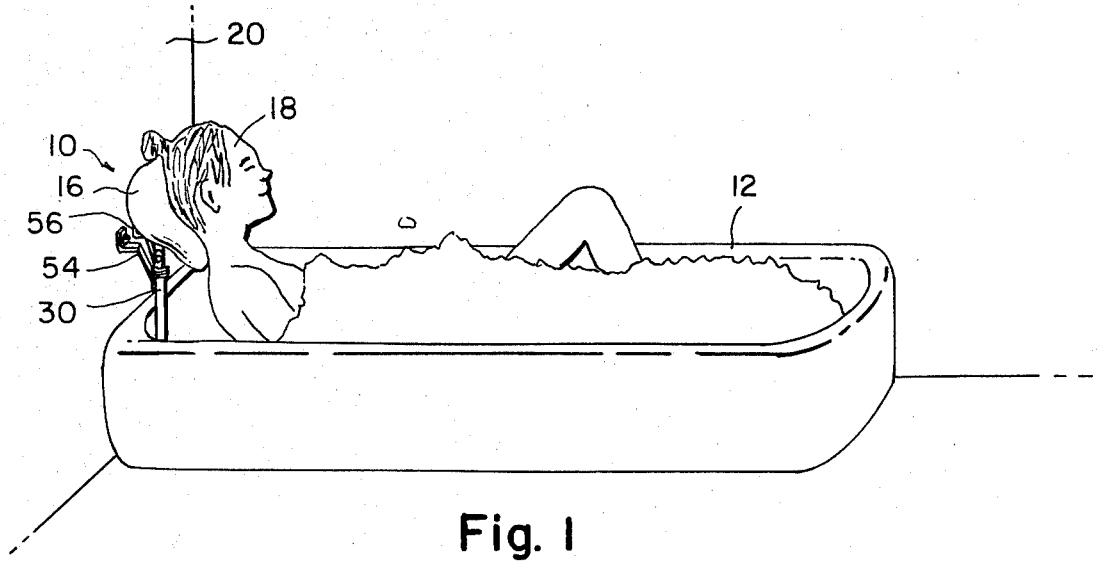
Figure 2:
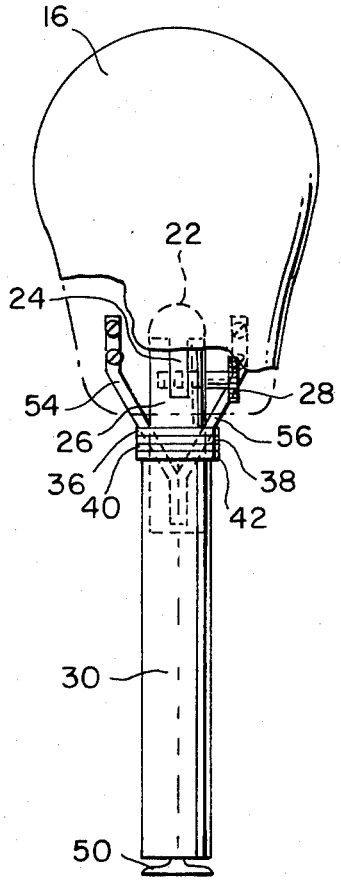
Figure 3:
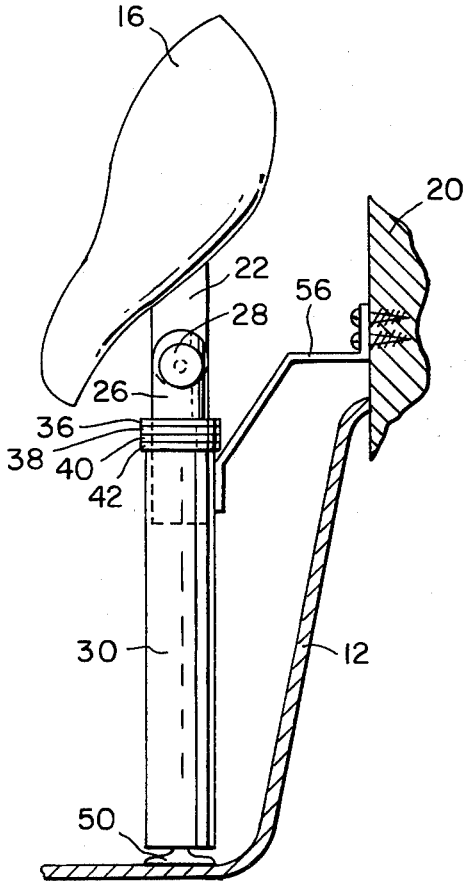

Referring now to the drawing, the head rest 10 of the invention is shown mounted in a bath tub 12. The head rest 10 has a head rest shell member 16 with a hollow cavity shaped to comfortably receive the back of the head of a person 18 taking a bath. The head rest shell member 16 is mounted to the bath tub 12 and a wall 20, such that it is pivotally and rotatably mounted to provide a wide viewing range for the bather as well as to conform to the most comfortable position of the bather. This mounting is achieved by a tongue member 22 which has an upper convex attachment, and a downwardly extending tenon 24. The tenon 24 fits into a channel formed in a first end of a post 26. The channel is formed at the top of the post and extends diammetrically across the post so that the tenon may pivot therein. The tenon is locked in its desired position by a lock wheel 28 extending through the first end of the post and through the tenon and channel, as shown in FIG. 2.

The post 26 has a second end which is telescopingly received in an elongated column 30, at the first end of the column. The column 30 is typically hollow, and the second end of the post fits loosely in the first end of the column, as shown in FIG. 2. The post 26 has a circumferential flange 36 affixed adjacent its second end and a ring bearing 38 attached to the underside of the flange 36, so that the ring bearing 38 rests upon a similar ring bearing 40 provided on a circumferential flange 42 affixed to the first end of the column 30. Thus, the ring bearing 38 rests upon the ring bearing 40 of the column to thereby allow for rotational movement between the post 26 and column 30 when the second end of the post is received in the first end of the column 30 and serves to support the post upon the column. Thus, rotational movement of the head rest shell member 16 is achieved by the ring bearings 38, 40, while pivotal movement in the forward and rearward directions is achieved by the tongue tenon 24 inserted in the channel of the first end of the post 26. It is noted that the rotational movement of the head rest shell member 16 is quickly and readily achieved since the post is mounted upon the column 30 in a floating manner by the circumferential flange 36 and ring bearing 38, so that the bather may readily view the space around him, while the pivotal movement of the shell 16 is locked in its desired position to conform to the optimal position of the head of the bather while he is bathing. This dual function allows a bather who suffers from an ailment that prevents him from supporting his neck himself to bathe with the greatest comfort and still allow him to view his surroundings.

Attached to the second, bottom end of the colum 30 is a suction cup 50 which supports the vertical orientation of the column 30 by engaging the bottom surface of the bath tub 12. The suction cup 50 is typically made of synthetic rubber. For mounting the column 30 to a wall 20 of the bath room, a pair of brackets 54, 56 are provided, with each bracket having a first end connected to the first end of the column 30, and a second end fixable to the wall as by screws.

In a preferred form of the invention, the ring bearings and circumferential flanges are made of chrome-plated steel, with each having an outer diameter of $2\frac{1}{8}$ inches. The post 26 is preferably also made of chrome-plated steel, and typically has a length of 6 inches and outer diameter of $1\frac{7}{8}$ inches. The column 30 is also made of chrome-plated steel and preferably has a length of 8 inches and an outer diameter of 2 inches. The head rest shell member 16 is preferably made of a compressed plastic and padded with sponge and overlaid with another layer of waterproof plastic, the waterproof layer covering the sponge material on the inside of the shell member which contacts the head of the bather.

While a specific embodiment of the invention has been shown and described, it is to be understood that numerous changes and modifications may be made without departing from the scope and spirit of the invention, as set out in the appended claims.

What is claimed is:

1. A head rest comprising, in combination:

(a) a head rest member upon which a head is rested, said head rest member being adapted to receive the back of the user's head;

(b) first means for pivotally and rotatively mounting said head rest member, said first means comprising a post having a first end adjacent to said rest member and a second end, said first means further comprising a tongue member that is connected to said head rest member and is rotatable in a vertical plane about a horizontal axis on said first end of said post, said post having a diametrical channel formed at said first end thereof in which said tongue member is mounted receivably for said rotation;

(c) locking means for locking said tongue member at a desired angular position in said channel of said post;

(d) means for mounting said first means to a stationary frame, said means comprising an elongated column having a first end and a second end remote from said first end, said elongated column having a hollow interior adjacent said first end, said second end of said post being positioned in said hollow interior of said first end of said elongated column;

(e) said post comprising a circumferential flange attached adjacent to said second end of said post and a circumferential ring bearing attached to said circumferential flange (f) said first end of said elongated column also having a circumferential flange and a circumferential ring bearing attached to said flange toward said second end of said post, said ring bearing of said post and said ring bearing of said column abutting each other to thereby allow for rotational movement of said rest member; and (g) said second means further comprising a suction cup attached to said second end of said elongated column for attaching said head rest to a stationary frame.

2. The head rest according to claim 1, wherein said means further comprises bracket means having a first end connected to said elongated column, and a second end fixable to the stationary frame.

3. The head rest according to claim 2, wherein said bracket means comprises a pair of brackets, with each said bracket having a first end connected to said elongated column adjacent said first end thereof.

4. The head rest according to claim 1, wherein said means further comprises bracket means extending from near said first end of said elongated column, said bracket means projecting outwardly from said column in a direction perpendicular to the length of said column, and said suction cup extends from said second end of said column in a direction parallel with the length of said column, whereby the head rest may be used in a bath tub, or the like.

5. The head rest according to claim 4, wherein said post extends into said hollow interior of said column in a telescoping manner; and said rest member comprises a hollow shell shaped to receive therein the back of a head.

* * * * *